US005302574A

United States Patent [19]

Lawrence et al.

[11] Patent Number: 5,302,574

[45] Date of Patent: Apr. 12, 1994

[54] THERMAL DYE TRANSFER RECEIVING ELEMENT WITH POLYESTER/POLYCARBONATE BLENDED DYE IMAGE-RECEIVING LAYER

[75] Inventors: Kristine B. Lawrence; Robert C. Daly, both of Rochester, N.Y.

[73] Assignee: Eastman Kodak Company, Rochester, N.Y.

[21] Appl. No.: 995,449

[22] Filed: Dec. 23, 1992

[51] Int. Cl.[5] ..... B41M 5/035; B41M 5/38

[52] U.S. Cl. ..... 503/227; 428/195; 428/412; 428/480; 428/913; 428/914

[58] Field of Search ..... 8/471; 428/195, 412, 428/480, 913, 914; 503/227

[56] References Cited

U.S. PATENT DOCUMENTS

| | | | |
|---|---|---|---|
| 3,256,241 | 6/1966 | Watson | 260/47 |
| 3,725,343 | 4/1973 | Schreyer | 260/42 C |
| 3,754,909 | 8/1973 | Feltzin et al. | 96/1.5 |
| 3,787,526 | 1/1974 | Burns et al. | 260/860 |
| 4,612,362 | 9/1986 | Lai et al. | 528/190 |
| 4,695,286 | 9/1987 | Vanier et al. | 8/471 |
| 4,740,497 | 4/1988 | Harrison et al. | 503/227 |
| 4,814,417 | 3/1989 | Sugimori | 528/182 |
| 4,897,377 | 1/1990 | Marbrow | 503/227 |
| 4,912,085 | 3/1990 | Marbrow | 503/227 |
| 4,914,179 | 4/1990 | Morris et al. | 528/272 |
| 4,927,803 | 5/1990 | Bailey et al. | 503/227 |
| 4,950,736 | 8/1990 | Sasaki et al. | 528/370 |
| 4,980,448 | 12/1990 | Tajiri et al. | 528/194 |
| 4,985,536 | 1/1991 | Figuly | 528/272 |
| 5,011,814 | 4/1991 | Harrison | 503/227 |
| 5,096,875 | 3/1992 | Martin | 503/227 |

FOREIGN PATENT DOCUMENTS

| | | | |
|---|---|---|---|
| 0475633 | 3/1992 | European Pat. Off. | 503/227 |
| 4-133795 | 5/1992 | Japan | 503/227 |

*Primary Examiner*—Bruce H. Hess
*Attorney, Agent, or Firm*—Harold E. Cole

[57] ABSTRACT

A dye-receiving element for thermal dye transfer includes a support having on one side thereof a dye image-receiving layer. Receiving elements of the invention are characterized in that the dye image-receiving layer comprises a miscible blend of an unmodified bisphenol-A polycarbonate having a number molecular weight of at least about 25,000 and a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring.

20 Claims, No Drawings

THERMAL DYE TRANSFER RECEIVING ELEMENT WITH POLYESTER/POLYCARBONATE BLENDED DYE IMAGE-RECEIVING LAYER

This invention relates to dye-receiving elements used in thermal dye transfer, and more particularly to polymeric dye image-receiving layers for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye receiving elements used in thermal dye transfer generally include a support (transparent or reflective) bearing on one side thereof a dye image-receiving layer, and optionally additional layers. The dye image-receiving layer conventionally comprises a polymeric material chosen from a wide assortment of compositions for its compatibility and receptivity for the dyes to be transferred from the dye donor element. Dye must migrate rapidly in the layer during the dye transfer step and become immobile and stable in the viewing environment. Care must be taken to provide a receiver layer which does not stick to the hot donor and where the dye moves from the surface and into the bulk of the receiver. An overcoat layer can be used to improve the performance of the receiver by specifically addressing these latter problems. An additional step, referred to as fusing, may be used to drive the dye deeper into the receiver.

Polycarbonates (the term "polycarbonate" as used herein means a polyester of carbonic acid and a diol or diphenol) and polyesters have been suggested for use in image-receiving layers. Polycarbonates have been found to be desirable image-receiving layer polymers because of their effective dye compatibility and receptivity. As set forth in U.S. Pat. No. 4,695,286, bisphenol-A polycarbonates of number average molecular weights of at least about 25,000 have been found to be especially desirable in that they also minimize surface deformation which may occur during thermal printing. These polycarbonates, however, do not always achieve dye transfer densities as high as may be desired, and their stability to light fading may be inadequate. U.S. Pat. No. 4,927,803 discloses that modified bisphenol-A polycarbonates obtained by co-polymerizing bisphenol-A units with linear aliphatic diols may provide increased stability to light fading compared to ummodified polycarbonates. Such modified polycarbonates, however, are relatively expensive to manufacture compared to the readily available bisphenol-A polycarbonates, and they are generally made in solution from hazardous materials (e.g. phosgene and chloroformates) and isolated by precipitation into another solvent. The recovery and disposal of solvents coupled with the dangers of handling phosgene make the preparation of specialty polycarbonates a high cost operation.

Polyesters, on the other hand, can be readily synthesized and processed by melt condensation using no solvents and relatively innocuous chemical starting materials. Polyesters formed from aromatic diesters (such as disclosed in U.S. Pat. No. 4,897,377) generally have good dye up-take properties when used for thermal dye transfer; however, they exhibit severe fade when the dye images are subjected to high intensity daylight illumination. Polyesters formed from alicyclic diesters are disclosed in copending U.S. Ser. No. 07/801,223 of Daly, the disclosure of which is incorporated by reference. These alicyclic polyesters also generally have good dye up-take properties, but their manufacture requires the use of specialty monomers which add to the cost of the receiver element. Polyesters formed from aliphatic diesters generally have relatively low glass transition temperatures, which frequently results in receiver-to-donor sticking at temperatures commonly used for thermal dye transfer. When the donor and receiver are pulled apart after imaging, one or the other fails and tears and the resulting images are unacceptable.

Polymers may be blended for use in the dye-receiving layer in order to obtain the advantages of the individual polymers and optimize the combined effects. For example, relatively inexpensive unmodified bisphenol-A polycarbonates of the type described in U.S. Pat. No. 4,695,286 may be blended with the modified polycarbonates of the type described in U.S. Pat. No. 4,927,803 in order to obtain a receiving layer of intermediate cost having both improved resistance to surface deformation which may occur during thermal printing and to light fading which may occur after printing. A problem with such polymer blends, however, results if the polymers are not completely miscible with each other, as such blends may exhibit a certain amount of haze. While haze is generally undesirable, it is especially detrimental for transparency receivers. Blends which are not completely compatible may also result in variable dye up-take, poorer image stability, and variable sticking to dye donors.

Fingerprint resistance is another desirable property for image-receiving layer polymers, since fingerprints present one potential image stability problem with thermal dye transfer images. Contaminants from fingerprints may attack the dyes and, therefore, degrade the image. The result is often a dye density loss due to crystallization.

Retransfer is another potential image stability problem with thermal dye transfer images. The receiver must act as a medium for dye diffusion at elevated temperatures, yet the transferred image dye must not be allowed to migrate from the final print. Retransfer is observed when another surface comes into contact with a final print. Such surfaces may include paper, plastics, binders, backside of (stacked) prints, and some album materials.

Accordingly, it would be highly desirable to provide a receiver element for thermal dye transfer processes with a dye image receiving layer comprising a polymer blend having excellent dye uptake and image dye stability, and which is essentially free from haze. It would be further desirable to provide such a receiver having improved fingerprint resistance and retransfer resistance, and which can be effectively printed in a thermal printer with significantly reduced thermal head pressures and printing line times.

These and other objects are achieved in accordance with this invention which comprises a dye-receiving element for thermal dye transfer comprising a support having on one side thereof a dye image-receiving layer, wherein the dye image-receiving layer comprises a miscible blend of an unmodified bisphenol-A polycarbonate having a number molecular weight of at least about 25,000 and a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring. Surprisingly, these alicyclic polyesters were found to be compatible with high molecular weight polycarbonates.

Examples of unmodified bisphenol-A polycarbonates having a number molecular weight of at least about 25,000 include those disclosed in U.S. Pat. No. 4,695,286. Specific examples include Makrolon 5700 (Bayer AG) and LEXAN 141 (General Electric Co.) polycarbonates.

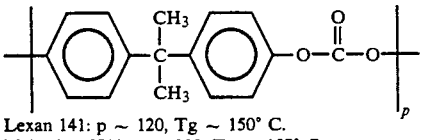

Lexan 141: p ~ 120, Tg ~ 150° C.
Makrolon 5700: p ~ 280, Tg ~ 157° C.

The polyester polymers used in the dye-receiving elements of the invention are condensation type polyesters based upon recurring units derived from alicyclic dibasic acids (Q) and diols (L) wherein (Q) represents one or more alicyclic ring containing dicarboxylic acid units with each carboxyl group within two carbon atoms of (preferably immediately adjacent to) the alicyclic ring and (L) represents one or more diol units each containing at least one aromatic ring not immediately adjacent to (preferably from 1 to about 4 carbon atoms away from) each hydroxyl group or an alicyclic ring which may be adjacent to the hydroxyl groups. For the purposes of this invention, the terms "dibasic acid derived units" and "dicarboxylic acid derived units" are intended to define units derived not only from carboxylic acids themselves, but also from equivalents thereof such as acid chlorides, acid anhydrides and esters, as in each case the same recurring units are obtained in the resulting polymer. Each alicyclic ring of the corresponding dibasic acids may also be optionally substituted, e.g. with one or more $C_1$ to $C_4$ alkyl groups. Each of the diols may also optionally be substituted on the aromatic or alicyclic ring, e.g. by $C_1$ to $C_6$ alkyl, alkoxy, or halogen.

In a preferred embodiment of the invention, the alicyclic rings of the dicarboxylic acid derived units and diol derived units contain from 4 to 10 ring carbon atoms. In a particularly preferred embodiment, the alicyclic rings contain 6 ring carbon atoms.

The alicyclic dicarboxylic acid units, (Q), are represented by structures such as:

Q1: 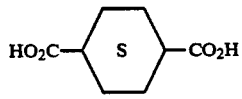

Q2: 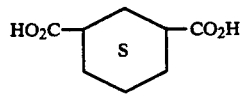

Q3: 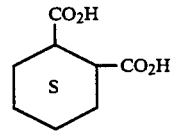

Q4: 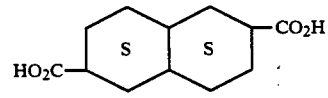

Q5: 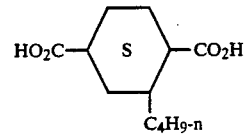

Q6: 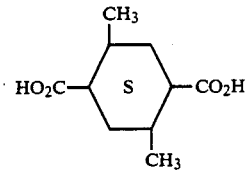

Q7: 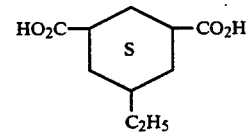

Q8: 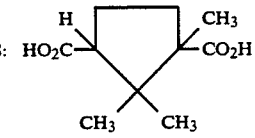

Q9: 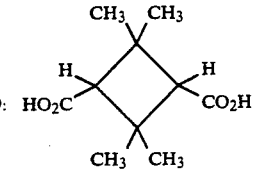

-continued
Q10: 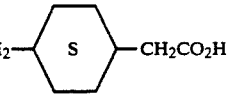
Q11: 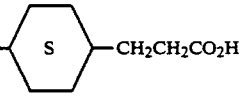
-continued
Q12: 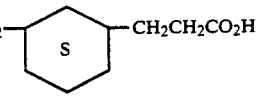
The diols, (L), are represented by structures such as:
L1: 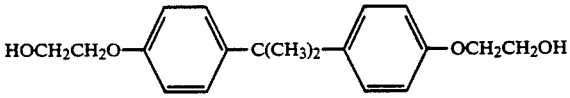
L2: 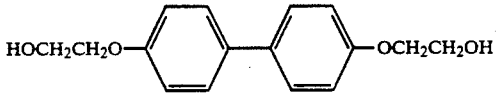
L3: 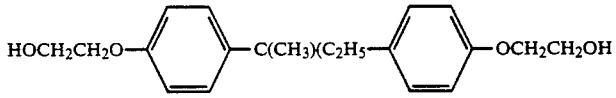
L4: 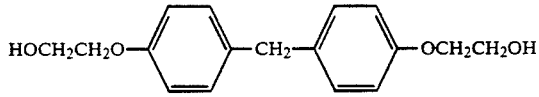
L5: 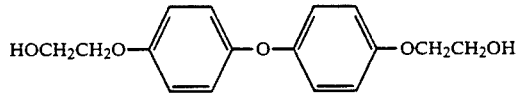
L6: 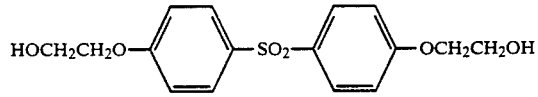
L7: 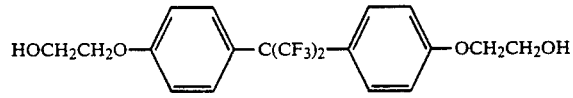
L8: 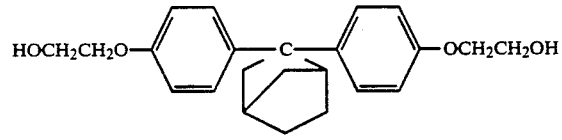
L8: 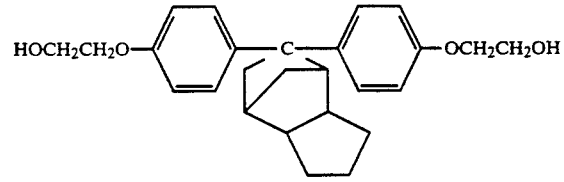
L10: 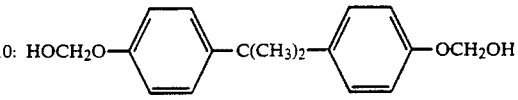

-continued
L11: 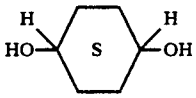
L12: 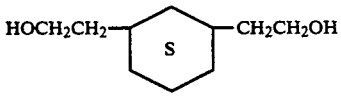
L13: 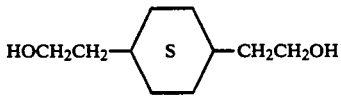
L14: 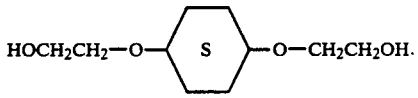
L15: 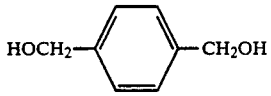
L16: 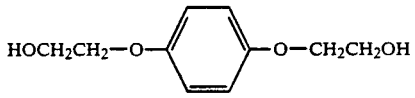
L17: 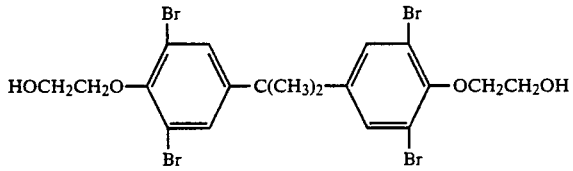
L18: 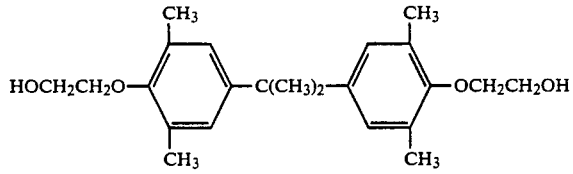
L19: 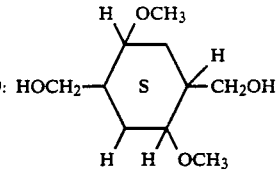
L20: 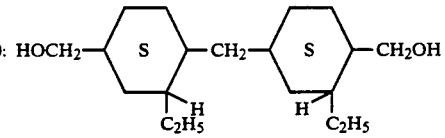
L21: 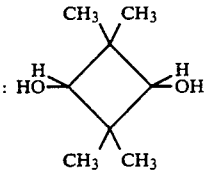

-continued

L22: 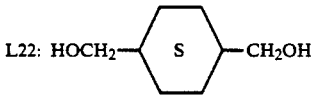

L23: 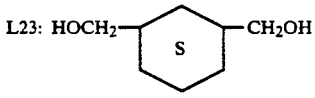

Optionally other groups, R and M, may be copolymerized to produce structures such as:

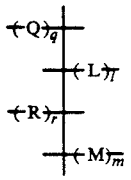

wherein q+r=l+m=100 mole % and q is at least 50 mole percent and l is at least 30 mole percent.

Diesters R and diols M may be added, e.g., to precisely adjust the polymer's Tg, solubility, adhesion, etc. Additional diester comonomers could have the cyclic structure of Q or be linear aliphatic units. The additional diol monomers may have aliphatic or aromatic structure but are not phenolic.

Suitable groups for R include dibasic aliphatic acids such as:

R1: $HO_2C(CH_2)_2CO_2H$
R2: $HO_2C(CH_2)_4CO_2H$
R3: $HO_2C(CH_2)_7CO_2H$
R4: $HO_2C(CH_2)_{10}CO_2H$

Suitable groups for M include diols such as:

M1: $HOCH_2CH_2OH$
M2: $HO(CH_2)_4OH$
M3: $HO(CH_2)_9OH$

M4: $HOCH_2C(CH_3)_2CH_2OH$
M5: $(HOCH_2CH_2)_2O$
M6: $HO(CH_2CH_2O)_nH$ (where n=2 to 50)

Among the necessary features of the polyesters for the blends of the invention is that they do not contain an aromatic diester such as terephthalate, and that they be compatible with the polycarbonate at the composition mixtures of interest. The polyester preferably has a Tg of from about 40° to about 100° C., and the polycarbonate a Tg of from about 100° to about 200° C. The polyester preferably has a lower Tg than the polycarbonate, and acts as a polymeric plasticizer for the polycarbonate. The Tg of the final polyester/polycarbonate blend is preferably between 40° C. and 100° C. Higher Tg polyester and polycarbonate polymers may be useful with added plasticizer.

In a preferred embodiment of the invention, the polyesters have a number molecular weight of from about 5,000 to about 250,000 more preferably from 10,000 to 100,000.

In a further preferred embodiment of the invention, the unmodified bisphenol-A polycarbonate and the polyester polymers are blended at a weight ratio to produce the desired Tg of the final blend and to minimize cost. Convienently, the polycarbonate and polyester polymers may be blended at a weight ratio of from about 75:25 to 25:75, more preferably from about 60:40 to about 40:60.

The following polyester polymers E-1 through E-17 (comprised of recurring units of the illustrated monomers) are examples of polyester polymers usable in the receiving layer polymer blends of the invention.

E-1 to E-5: Polymers which are preferred and considered to be derived from 1,4-cyclohexanedicarboxylic acid, ethylene glycol, and 4,4'-bis(2-hydroxyethyl) bisphenol-A.

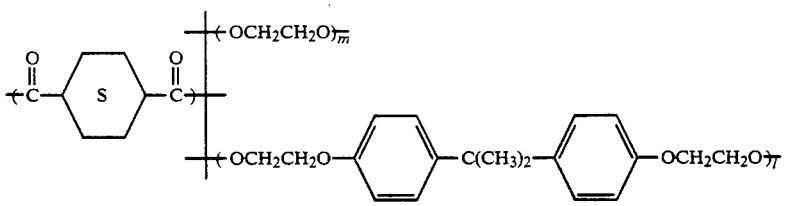

| | | | |
|---|---|---|---|
| E-1: | l = 50 mole % | m = 50 mole % | Tg = 51° C. |
| E-2: | l = 60 mole % | m = 40 mole % | |
| E-3: | l = 30 mole % | m = 70 mole % | |
| E-4: | l = 75 mole % | m = 25 mole % | Tg = 71° C. |
| E-5: | l = 85 mole % | m = 15 mole % | |

E-6: A polymer considered to be derived from 1,4-cyclohexanedicarboxylic acid and 4,4'-bis(2-hydroxyethyl) bisphenol-A

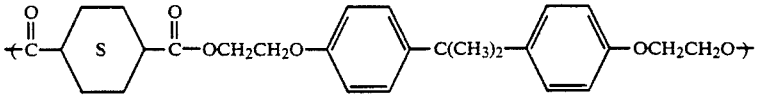

E-7 and E-8: Polymers considered to be derived from 1,4-cyclohexanedicarboxylic acid, ethylene glycol and 1,4-cyclohexanedimethanol

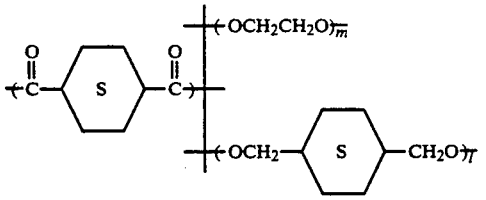

E-7: l = 50 mole % m = 50 mole %
E-8: l = 70 mole % m = 30 mole %

E-9: A polymer considered to be derived from 1,4-cyclohexanedicarboxylic acid and 1,4-cyclohexane dimethanol

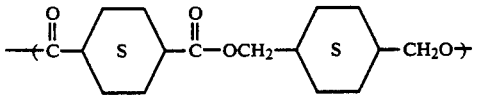

E-10 and E-11: Polymers considered to be derived from 1,4-cyclohexanedicarboxylic acid, 4,4'-bis(hydroxyethyl) bisphenol-A, and 4,4'-(2-norbornylidene)-bis(2-hydroxyethyl)bisphenol

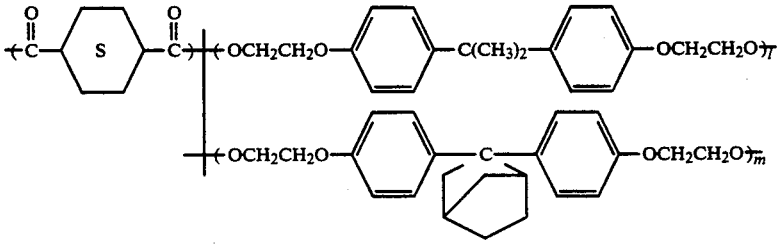

E-10: l = 80 mole % m = 20 mole %
E-11: l = 90 mole % m = 10 mole %

E-12 and E-13: Polymers considered to be derived from 1,4-cyclohexanedicarboxylic acid, ethylene glycol, and 4,4'-(2-norbornylidene)-bis(2-hydroxyethyl)bisphenol

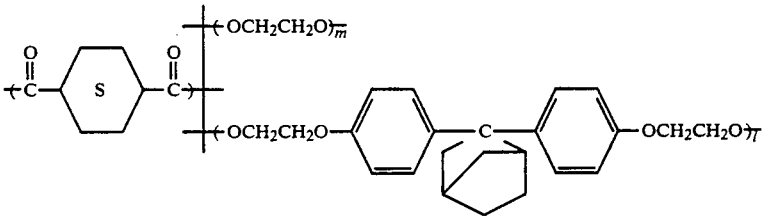

E-12: l = 30 mole % m = 70 mole %
E-13: l = 50 mole % m = 50 mole %

E-14: A polymer considered to be derived from 1,4-cyclohexanedicarboxylic acid, ethylene glycol, and 4,4'-(hexahydro-4,7-methanoindene-5-ylidene)-bis(2-hydroxyethyl)bisphenol

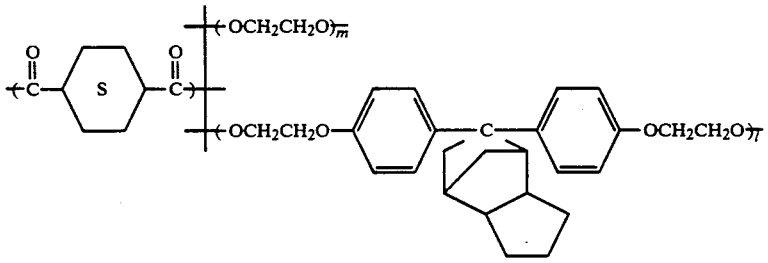

l = 50 mole % m = 50 mole %

E-15: A polymer considered to be derived from 1,4-cyclohexanedicarboxylic acid, azelaic acid, ethylene glycol and 4,4'-bis(2-hydroxyethyl)bisphenol-A

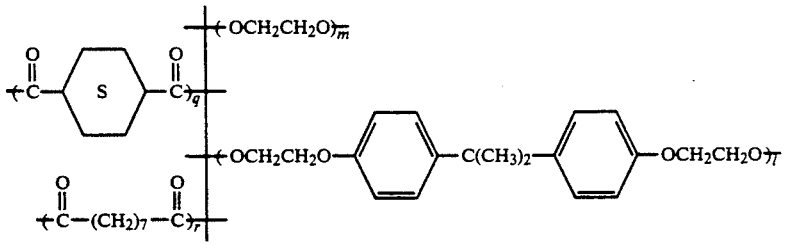

q = 75 mole % r = 25 mole % l, m = 50 mole %

E-16 and E-17: A polymer considered to be derived from 1,3-cyclohexanedicarboxylic acid, ethylene glycol, and 4,4'-bis(2-hydroxyethyl)bisphenol-A

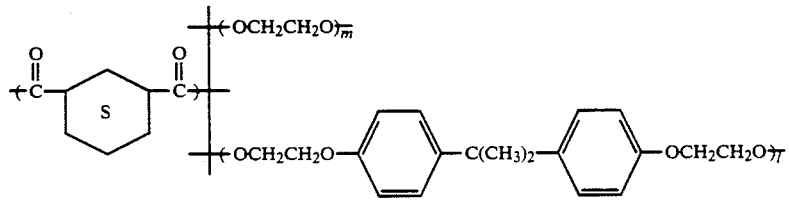

E-16: l = 50 mole % m = 50 mole %
E-17: l = 90 mole % m = 10 mole %

Other polyester polymers usable in the blends of the invention include E-18 to E-31 listed below:

| Polymer | Alicyclic Diacid Mole % O | Alternate Diacid Mole % R | Glycol Mole % L | Alternate Glycol Mole % M |
|---|---|---|---|---|
| E-18 | 100% Q1 | — | 30% L2 | 70% M1 |
| E-19 | 100% Q1 | — | 50% L9 | 48% M1<br>2% M6 (n~35) |
| E-20 | 100% Q1 | — | 50% L13 | 50% M1 |
| E-21 | 100% Q1 | — | 50% L21 | 50% M1 |
| E-22 | 100% Q2 | — | 70% L11 | 30% M1 |
| E-23 | 100% Q2 | — | 100% L16 | — |
| E-24 | 70% Q2 | 30% R2 | 50% L21,<br>50% L11 | — |
| E-25 | 50% Q1,<br>50% Q2 | — | 50% L1 | 50% M1 |
| E-26 | 50% Q1,<br>50% Q2 | — | 100% L5 | — |
| E-27 | 100% Q4 | — | 100% L10 | — |
| E-28 | 70% Q4 | 30% R1 | 50% L1 | 50% M1 |
| E-29 | 100% Q6 | — | 100% L14 | — |
| E-30 | 100% Q7 | — | 50% L14 | 50% M4 |
| E-31 | 100% Q8 | — | 30% L6 | 70% M1 |

The support for the dye-receiving element of the invention may be transparent or reflective, and may comprise a polymeric, a synthetic paper, or a cellulosic paper support, or laminates thereof. Examples of transparent supports include films of poly(ether sulfones), polyimides, cellulose esters such as cellulose acetate, poly(vinyl alcohol-co-acetals), and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference.

The dye image-receiving layer may be present in any amount which is effective for its intended purpose. In general, good results have been obtained at a receiver layer concentration of from about 0.5 to about 10 g/m$^2$.

Resistance to sticking during thermal printing may be enhanced by the addition of release agents to the dye receiving layer or to an overcoat layer, such as silicone based compounds, as is conventional in the art.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention. The synthesis example is representative, and other polyesters may be prepared analogously or by other methods know in the art.

Preparation of Polyester E-9: poly(methylene 1,4-cyclohexane methylene carbonyl 1,4-cyclohexane carbonyl)

The following quantities of reactants were charged to a reactor purged with nitrogen: 8.11 kg (44.1 mol) of dimethyl cis/trans 1,4-cyclohexanedicarboxylate; 6.72 kg (50.7 mol) of trans 1,4-cyclohexanedimethanol; and 45.4 gms of a 2.6 wt % of tetraisopropyl orthotitanate. Under a nitrogen purge, the reactor was heated to 220° C. and maintained there for one hour. The temperature was then raised to 240° C. and maintained for an additional hour. At this point, traps were drained and drainings were recorded. The temperature was increased to 260° C. and held there for 30 minutes. Traps were again drained and drainings recorded. The temperature was raised to 290° C., the pressure was reduced to 53 Pa. The reactor was then placed under 667 Pa vacuum with reactor temperature at 290° C. and left there for three hours. Once buildup was complete, the polymer was extruded from the reactor into water using an extruding die. The resulting polymer was dried in a vacuum oven at 80° C. under a nitrogen purge for four hours. The polymer was ground yielding 7.94 kg of material. Tg=66° C.; Tm=213.45° C.; IV=0.843.

RECEIVING ELEMENT EXAMPLE 1

Dye-receiving element DR-1 used for haze measurements was prepared by coating the following layers in the order recited on a 175 μm thick poly(ethylene terephthalate) support:

(1) Subbing layer of poly(acrylonitrile-co-vinylidene chloride-co-acrylic acid) (15:79:6 wt. ratio) (0.11 g/m$^2$) coated from distilled water, and (2) a dye receiving layer composed of a blend of Bayer AG Makrolon 5700 unmodified bisphenol A polycarbonate (1.61 g/m$^2$)(Tg=157° C.) and polyester E-9 (1.61 g/m$^2$) containing diphenyl phthalate (0.32 g/m$^2$) and dibutyl phthalate (0.32 g/m$^2$) as plasticizers and Fluorad FC-431 (surfactant of 3M Co.) (0.016 g/m$^2$) coated from dichloromethane.

Comparison receivers C-1 and C-2 were prepared by coating the following dye receiving layers in place of the invention dye receiving layer:

C-1: Receiving layer composed of a blend of Bayer AG Makrolon 5700 unmodified bisphenol A polycarbonate (1.61 g/m$^2$) and a random 50:50 mol % copolymer of bisphenol-A carbonate with diethylene glycol (the modified polycarbonate illustrated below) (1.61 g/m$^2$) and Fluorad FC-431 (3M Co.) (0.016 g/:m$^2$) coated from dichloromethane.

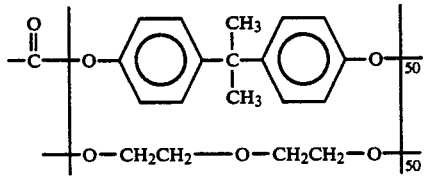

Modified Polycarbonate:
4,4'-isopropylidene-bisphenol-co-2,2'-oxydiethanol polycarbonate (50:50) random copolymer, Tg ~ 69° C.

C-2: Receiving layer composed of a blend of Bayer AG Makrolon 5700 unmodified bisphenol A polycarbonate (1.61 g/m$^2$) and the modified polycarbonate shown above (1.61 g/m$^2$) containing diphenyl phthalate (0.32 g/m$^2$) and dibutyl phthalate (0.32 g/m$^2$) as plasticizers and Fluorad FC-431 (3M Co.) (0.016 g/m$^2$) coated from dichloromethane.

After drying, the degree of haze for each receiver was determined according to the standard ASTM test procedure (Test Method D1003). The results from the haze measurements are summarized in Table I below.

TABLE I

| RECEIVER | % HAZE |
|---|---|
| Uncoated PET Support | 0.5 |
| DR-1 | 0.4 |
| C-1 | 6.6 |
| C-2 | 5.9 |

RECEIVING ELEMENT EXAMPLE 2

Dye-receiving element DR-2 used for evaluation as receiving layers for thermal imaging was prepared by coating the following layers in the order recited on a titanium dioxide-pigmented polyethylene-overcoated paper stock:

(1) Subbing layer of poly(acrylonitrile-co-vinylidene chloride-co-acrylic acid) (15:78:7 wt. ratio) (0.11 g/m$^2$) coated from 2-butanone, and (2) Dye receiving layer composed of a blend of Bayer AG Makrolon 5700 unmodified bisphenol A polycarbonate (1.61 g/m$^2$) and polyester E-9 (1.61 g/m$^2$) and Fluorad FC-431 (3M Co.) (0.016 g/m$^2$) coated from dichloromethane.

Dye-receiving element DR-3 and comparison dye-receiving elements C-3, C-4 and C-5 were prepared by coating the following dye-receiving layers in place of the DR-2 receiving layer:

DR-3 receiving layer composed of a blend of Bayer AG Makrolon 5700 unmodified bisphenol A polycarbonate (1.61 g/m$^2$) and polyester E-9 (1.61 g/m$^2$) containing diphenyl phthalate (0.32 g/m$^2$)

and dibutyl phthalate (0.32 g/m$^2$) as plasticizers and Fluorad FC-431 (3M Co.) (0.016 g/m$^2$) coated from dichloromethane.

C-3: Receiving layer composed of Bayer AG Makrolon 5700 unmodified bisphenol A polycarbonate (3.23 g/m$^2$) and Fluorad FC-431 (3M Co.) (0.016 g/m$^2$) coated from dichloromethane.

C-4: Receiving layer composed of a blend of Bayer AG Makrolon 5700 unmodified bisphenol A polycarbonate (1.61 g/m$^2$) and the modified polycarbonate shown in Example 1 above (1.61 g/m$^2$) and Fluorad FC-431 (3M Co.) (0.016 g/m$^2$) coated from dichloromethane.

C-5: Receiving layer composed of a blend of Bayer AG Makrolon 5700 unmodified bisphenol A polycarbonate (1.61 g/m$^2$) and the modified polycarbonate shown in Example 1 above (1.61 g/m$^2$) containing diphenyl phthalate (0.32 g/m$^2$) and dibutyl phthalate (0.32 g/m$^2$) as plasticizers and Fluorad FC-431 (3M Co.) (0.016 g/m$^2$) coated from dichloromethane.

All coatings were dried at ambient room conditions for at least 16 hours prior to evaluation.

A dye donor element of sequential areas of cyan, magenta and yellow dye was prepared by coating the following layers in order on a 6 μm poly(ethylene terephthalate) support:

(1) Subbing layer of Tyzor TBT (titanium tetra-n-butoxide) (duPont Co.) (0.12 g/m$^2$) from a n-propyl acetate and 1-butanol solvent mixture.

(2) Dye-layer containing Cyan Dye 1 (0.42 g/m2) illustrated below, a mixture of Magenta Dye 1 (0.11 g/m2) and Magenta Dye 2 (0.12 g/m2) illustrated below, or Yellow Dye 1 illustrated below (0.20 g/m$^2$) and S-363N1 (a micronized blend of polyethylene, polypropylene and oxidized polyethylene particles) (Shamrock Technologies, Inc.) (0.02 g/m$^2$) in a cellulose acetate propionate binder (2.5% acetyl, 45% propionyl) (0.15–0.70 g/m$^2$) from a toluene, methanol, and cyclopentanone solvent mixture.

On the reverse side of the support was coated:

(1) Subbing layer of Tyzor TBT (0.12 g/m$^2$) from a n-propyl acetate and 1-butanol solvent mixture.

(2) Slipping layer of Emralon 329 (a dry film lubricant of poly(tetrafluoroethylene) particles in a cellulose nitrate resin binder) (Acheson Colloids Corp.) (0.54 g/m$^2$), p-toluene sulfonic acid (0.0001 g/m$^2$), BYK-320 (copolymer of a polyalkylene oxide and a methyl alkylsiloxane) (BYK Chemie, USA) (0.006 g/m$^2$), and Shamrock Technologies Inc. S-232 (micronized blend of polyethylene and carnauba wax particles) (0.02 g/m$^2$), coated from a n-propyl acetate, toluene, isopropyl alcohol and n-butyl alcohol solvent mixture.

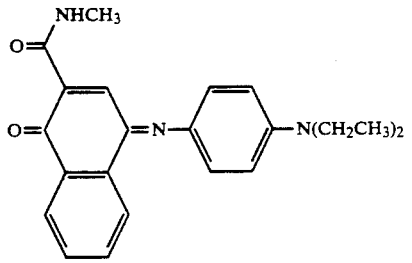

(Cyan Dye 1)

-continued

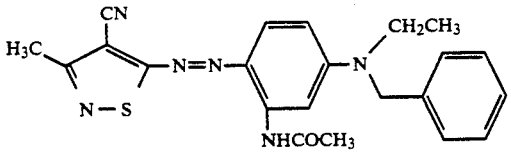

(Magenta Dye 1)

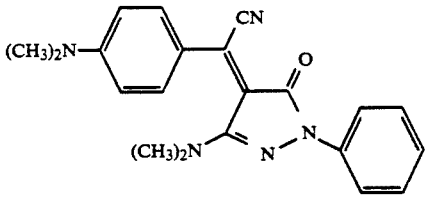

(Magenta Dye 2)

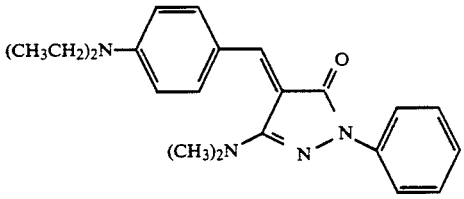

(Yellow Dye 1)

The dye side of the dye-donor element approximately 10 cm×13 cm in area was placed in contact with the polymeric receiving layer side of the dye-receiver element of the same area. The assemblage was fastened to the top of a motor-driven 56 mm diameter rubber roller and a TDK Thermal Head L-231, thermostated at 22° C., was pressed with a spring at a force of 36 Newtons (3.2 kg) against the dye-donor element side of the assemblage pushing it against the rubber roller.

The imaging electronics were activated and the assemblage was drawn between the printing head and roller at 7.0 mm/sec. Coincidentally, the resistive elements in the thermal print head were pulsed in a determined pattern for 29 μsec/pulse at 129 μsec intervals during the 33 msec/dot printing time to create an image. When desired, a stepped density image was generated by incrementally increasing the number of pulses/dot from 0 to 255. The voltage supplied to the print head was approximately 24.5 volts, resulting in an instantaneous peak power of 1.27 watts/dot and a maximum total energy of 9.39 mjoules/dot.

Individual cyan, magenta and yellow images were obtained by printing from three dye-donor patches. When properly registered a full color image was formed. The Status A red, green, and blue reflection density of the stepped density image at maximum density, Dmax, were read and recorded.

The step of each dye image nearest a density of 1.0 was then subjected to exposure for 1 week, 50 kLux, 5400° K., approximately 25% RH. The Status A red, green and blue reflection densities were compared before and after fade and the percent density loss was calculated. The results are presented in Table II below.

TABLE II

| RECEIVER | DYE UPTAKE (Dmax) | | | STATUS A % FADE (Initial O.D. = 1.0) | | |
|---|---|---|---|---|---|---|
| | Red | Green | Blue | Red | Green | Blue |
| DR-2 | 2.42 | 2.56 | 2.33 | 18 | 34 | 24 |
| DR-3 | 2.89 | 2.74 | 2.51 | 20 | 26 | 14 |
| C-3 | 2.14 | 2.36 | 2.19 | 25 | 62 | 52 |
| C-4 | 2.04 | 2.04 | 1.96 | 18 | 25 | 15 |
| C-5 | 2.44 | 2.26 | 2.23 | 20 | 20 | 15 |

A receiver layer produced by solvent coating a mixture of an alicyclic polyester and polycarbonate was not hazy and gave higher dye uptake and comparable dye fade relative to the polycarbonate/polycarbonate blend. The advantages of replacing the modified polycarbonate in the blended receiver with the alicyclic polyester include elimination of haze in coatings, reduction of manufacturing costs, and reduction of environmental hazards. The compatible alicyclic polyester and polycarbonate blends have also been found to help minimize retransfer of dye from an imaged receiver and provide improved fingerprint resistance compared to incompatible polymer blends.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer, wherein the dye image-receiving layer comprises a miscible blend of an unmodified bisphenol-A polycarbonate having a number molecular weight of at least about 25,000 and a polyester comprising recurring dibasic acid derived units and diol derived units, at least 50 mole % of the dibasic acid derived units comprising dicarboxylic acid derived units containing an alicyclic ring within two carbon atoms of each carboxyl group of said dicarboxylic acid, and at least 30 mole % of the diol derived units containing an aromatic ring not immediately adjacent to each hydroxyl group of said diol or an alicyclic ring.

2. The element of claim 1, wherein the alicyclic rings of the dicarboxylic acid derived units comprise from 4 to 10 ring carbon atoms.

3. The element of claim 2, wherein the alicyclic rings of the dicarboxylic acid derived units comprise 6 ring carbon atoms.

4. The element of claim 1, wherein the polyester has a number average molecular weight of from 5,000 to 250,000.

5. The element of claim 4, wherein the polyester has a number average molecular weight of from 10,000 to 100,000.

6. The element of claim 1, wherein the polyester has a glass transition temperature greater than about 40° C.

7. The element of claim 6, wherein the polyester has a glass transition temperature between 40° C. and 100° C.

8. The element of claim 1, wherein the dicarboxylic acid derived units are derived from 1,4-cyclohexanedicarboxylic acid and the diol derived units are derived from 0 to 70 mole percent ethylene glycol and 30 to 100 mole percent 4,4'-bis(2-hydroxyethyl) bisphenol-A.

9. The element of claim 1, wherein the dicarboxylic acid derived units are derived from 1,4-cyclohexanedicarboxylic acid and the diol derived units are derived from 0 to 70 mole percent ethylene glycol and 30 to 100 mole percent 1,4-cyclohexanedimethanol.

10. The element of claim 1, wherein the unmodified bisphenol-A polycarbonate and the polyester polymers are blended at a weight ratio of from 75:25 to 25:75.

11. The element of claim 1, wherein the support is a transparent support.

12. The element of claim 1, wherein at least 30 mole % of the diol derived units of the polyester contain an alicyclic ring.

13. The element of claim 12, wherein the alicyclic rings of the diol derived units comprise from 4 to 10 ring carbon atoms.

14. The element of claim 12, wherein the alicyclic rings of the diol derived units comprise 6 ring carbon atoms.

15. The element of claim 12, wherein the polyester has a glass transition temperature between 40° C. and 100° C.

16. The element of claim 12, wherein the support is a transparent support.

17. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, wherein the dye image-receiving layer comprises a miscible blend of an unmodified bisphenol-A polycarbonate having a number molecular weight of at least about 25,000 and a polyester comprising recurring dibasic acid derived units and diol derived units, at least 50 mole % of the dibasic acid derived units comprising dicarboxylic acid derived units containing an alicyclic ring, within two carbon atoms of each carboxyl group of said corresponding dicarboxylic acid, and at least 30 mole % of the diol derived units containing an aromatic ring not immediately adjacent to each hydroxyl group of said diol or an alicyclic ring.

18. The process of claim 17, wherein the dye-receiving element support is a transparent support.

19. A thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein the dye image-receiving layer comprises a miscible blend of an unmodified bisphenol-A polycarbonate having a number molecular weight of at least about 25,000 and a polyester comprising recurring dibasic acid derived units and diol derived units, at least 50 mole % of the dibasic acid derived units comprising dicarboxylic acid derived units containing an alicyclic ring within two carbon atoms of each carboxyl group of said dicarboxylic acid, and at least 30 mole % of the diol derived units containing an aromatic ring not immediately adjacent to each hydroxyl group of said diol or an alicyclic ring.

20. The assemblage of claim 19, wherein the dye-receiving element support is a transparent support.

* * * * *